United States Patent [19]

Weinrauch

[11] 4,371,084

[45] Feb. 1, 1983

[54] HAIR STYLING ACCOUTREMENTS

[76] Inventor: David Weinrauch, 1106 Harbormaster Shipyard, Hilton Head Island, S.C. 29928

[21] Appl. No.: 157,842

[22] Filed: Jun. 9, 1980

[51] Int. Cl.[3] ..... A47F 1/12; A47F 1/14

[52] U.S. Cl. ..... 211/126; 211/49 D; 312/73; 221/185

[58] Field of Search ..... 221/185, 312, 33–63, 221/165; 211/49 D, 126; 312/45, 72, 73; 206/341, 346, 347

[56] References Cited

U.S. PATENT DOCUMENTS

| | | | |
|---|---|---|---|
| 2,087,181 | 7/1937 | Conway | 221/185 X |
| 2,174,712 | 10/1939 | Warner . | |
| 2,347,823 | 5/1944 | Goodman et al. . | |
| 2,441,352 | 5/1948 | Frank . | |
| 2,799,399 | 7/1957 | Cannon | 211/49 D |
| 2,803,274 | 8/1957 | Zubal et al. | 221/165 |
| 3,355,231 | 11/1967 | Kegel | 312/45 |
| 3,567,006 | 3/1971 | Bell et al. | 221/165 X |
| 3,948,417 | 4/1976 | McCain . | |
| 4,185,753 | 1/1980 | Leto . | |

*Primary Examiner*—David A. Scherbel

*Attorney, Agent, or Firm*—Cushman, Darby & Cushman

[57] ABSTRACT

Various devices are provided for use by a cosmetologist when giving permanent wave treatments, or the like, to customers, and a method of efficiently practicing cosmetology. End-wrap papers are stacked in a self-feeding manner in a dispenser container, and the container is inserted into a holder mounted on a wristband on the cosmetologist's wrist. A supporting structure having a plurality of trays containing hair rollers therein, and supporting a plurality of dispensers for hair-styling rods, is placed adjacent the customer. The end-wrap papers may be removed one-at-a-time from the wrist holder, and the rods and hair rollers may be removed one at a time from the dispensers associated with the supporting structure, without customer assistance, and in an efficient manner.

4 Claims, 9 Drawing Figures

HAIR STYLING ACCOUTREMENTS

BACKGROUND AND SUMMARY OF THE INVENTION

The invention relates to structures particularly adapted for use by cosmetologists, and a method of practicing cosmetology, that makes many cosmetology functions much more simple and efficient,and eliminates the need for customer assistance. Conventionally, customers assist the cosmetologist treating their hair by handing the cosmetologist end-wrap papers, rollers, or the like. Such procedures are less efficient and professional than desired. There have been proposals for mounting end-wrap papers in wrist holders (see U.S. Pat. Nos. 2,347,823 and 4,185,753) and for mounting hair rollers in readily accessible dispensers (see U.S. Pat. No. 3,948,417), however, such proposals have not been entirely successfuly.

Prior proposals for wrist-mounted end-wrap paper dispensers have necessitated the filling of dispensers with end-wrap papers, requiring some disassembly of the container, spring compression, or the like to effect replacement. Such a procedure is inconvenient when a cosmetologist has a busy schedule, and especially when the container runs out of end-wrap papers during a permanent-wave treatment. Prior art proposals for mounting hair rollers and dispensers readily accessible to the cosmetologist also have been somewhat deficient. Such dispensers have conventionally not been suitable for use with conventional hair-styling rods. (The term "rods" as used in the present specification and claims refers to a conventional hair-styling rod have an elongated neck with a head formed at least at one end thereof and with an elastic band extending from a portion of the rod opposite the head to a plug which is inserted in the rod head). The rod bands often get tangled, and the rods are difficult to remove one at a time during an actual permanent-wave treatment. Hair rolling dispensing has often been provided utilizing complicated spring-loading mechanisms which are unnecessarily expensive and bulky.

According to the present invention, structures and a method are provided that solve essentially all of the problems associated with prior art proposals for supporting end-wrap papers and hair rollers or the like. According to the present invention, a holder for end-wrap papers is provided that has no moving parts. End-wrap papers are mounted in a disposal container in a self-feeding manner and are merely inserted into or withdrawn from the holder as necessary to replenish the supply of end-wrap papers. The simplicity of construction reduces the cost of production of the holder and allows the holder to be readily refilled even during an actual permanent-wave treatment without customer assistance and without the necessity of the cosmetologist leaving the customer.

Also according to the present invention a support structure and dispensers associated therewith are provided for conveniently mounting rods and hair rollers so that they may be removed one-at-a-time for use by the cosmetologist without customer assistance and without interruption of the hair treating functions. The rods are removed without entanglement of the bands, and the rollers are dispensed without spring-loading mechanisms, or the like. In general, a simple, readily utilizable arrangement is provided.

It is the primary object of the present invention to provide structures and a method which facilitate the dispensing of end-wrap papers, rods, hair rollers, and the like for a cosmetologist without customer assistance or interruption of hair-treatments, and in a simple and inexpensive manner. This and other objects of the invention will become clear from an inspection of the detailed description of the invention, and from the appended claims.

DETAILED DESCRIPTION OF THE DRAWINGS

Figure 1:
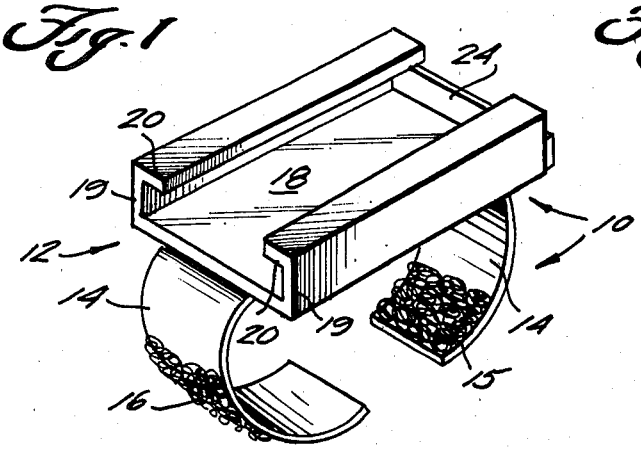
FIG. 1 is a perspective view of an exemplary end-wrap paper holder according to the present invention.
Figure 2:
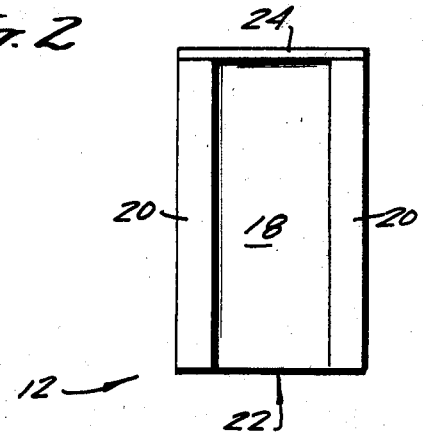
FIG. 2 is a top plan view of the holder of FIG. 1.

An exemplary holder for end-wrap paper according to the present invention is illustrated generally at 10 in FIGS. 1 and 2. The holder includes a body portion 12 which has no moving parts, with means for attaching the body portion 12—such as the flexible wristband 14—to the wrist of a user (cosmetologist) of the holder. The strap 14 may be affixed to the bottom of the base 18 in any conventional manner with a free end extending outwardly from each side of the point of attachment so that the edges of the strap 14 are substantially parallel to the sidewalls 19 upstanding from base 18. Cooperating fastening means—such as hook 15 and loop 16 conventional fasteners (i.e., Velcro)—are provided for attachment of the strap ends together to form a closed loop around the user's wrist.

Figure 3:
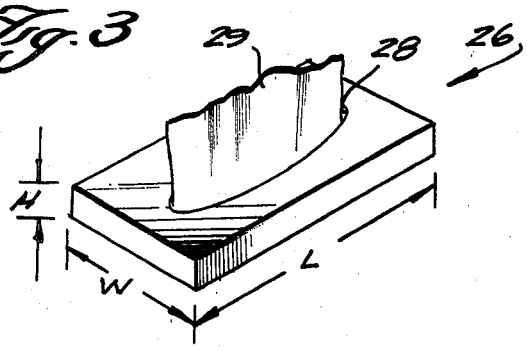
FIG. 3 is a perspective view of an exemplary container containing end-wrap papers in a self-feeding manner for use with the holder of FIG. 1.

In addition to the upstanding sidewalls 19, the body 12 includes the lips 20 formed integrally with the sidewalls and extending toward each other substantially parallel to the base 18. The lips 20 are spaced from each other to form a partially-open top. The body 12 further comprises an end wall 24 extending substantially perpendicular to the base and to the sidewalls and substantially spanning the distance between the sidewalls. Opposite the end wall 24 the holder is open, as illustrated at 22 in FIG. 2, and is adapted to receive a container 26 (see FIG. 3) of end-wrap papers therein. The height of the wall 24 is preferably slightly less than the height of the sidewalls 19 so that ready access is available to the container 26 portion adjacent the end wall 24 when a container is received by the holder 10.

The container 26 contains a plurality of end-wrap papers mounted in a conventional self-feeding manner (as is conventional is certain types of cardboard tissue dispensers). The container 26 preferably is disposable (e.g., made of cardboard of paperboard) and has a slit 18 formed on the top thereof through which an end-wrap paper 29 extends. The slit 28 may originally be closed by a removable insert, which insert is removed prior to use of the container 26. The height H (see FIG. 3) of the container 26 is slightly less than the distance between the top of base 18 and the bottom of lips 20; the width W of the container 26 is slightly less than the distance between the inside surfaces of sidewalls 19 of the holder 10; and the length L of the container 26 is substantially equal to the dimensions of the sidewalls 19 from the open front end 22 to the end wall 24. As illustrated, the container 26 thus has a parallelepiped configuration sized and dimensioned to be readily received within the volume defined by the body 12. By placing the dimension W of the container 26 in registry with the open end 22 of the body 12, the container 26 may be slid between the walls 19, lips 20, base 18 and end wall 24 of the body 12 with the end-wrap papers 29 extending through the open-top of the holder 12 in a self-feeding manner so that they may be readily removed one-by-one.

Figure 4:
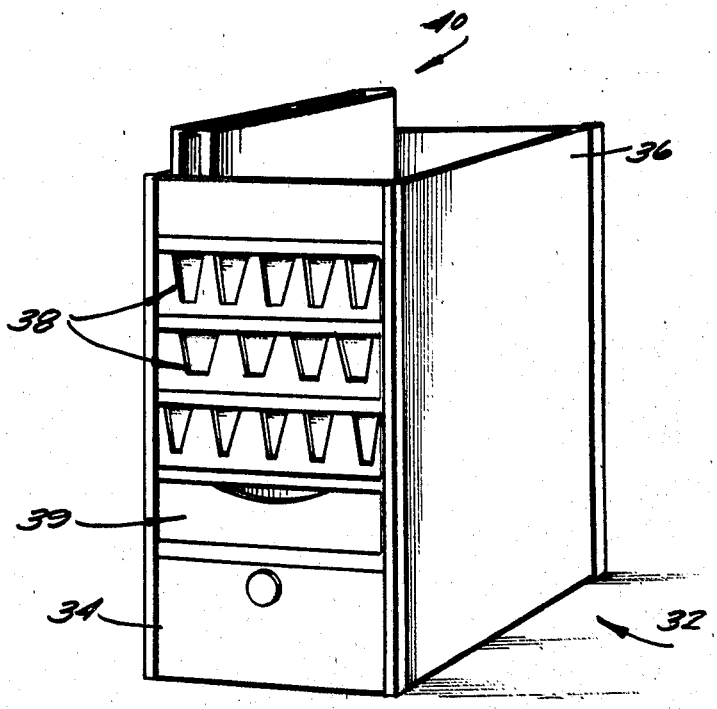
FIG. 4 is a perspective view of an exemplary support structure according to the present invention.

An exemplary support structure that may be utilized according to the present invention is illustrated at 32 in FIG. 4. The support structure may comprise a removable drawer 34 at the bottom thereof, an open-top tray 36 at the top thereof, and slidably removable trays 38, 39 therein, supported in much the same manner as drawers in a dresser. Any necessary accoutrements that the cosmetologist might need may be supported by the structure 32, such as rods, hair rollers, hair picks, cotton, and the like. For instance cotton, treating liquids, and the like may be disposed within the drawer 34, hair picks may be disposed in the slidable tray 39, hair rollers of a variety of sizes in the tray 38, and rod dispensers 40 may be mounted in the open-top tray 36. The support structure 32 is placed adjacent the sight at which the customer is to be treated so as to be readily accessible. The structure 32 may be mounted on rollers, placed on a counter surface, or the like.

Figure 5:
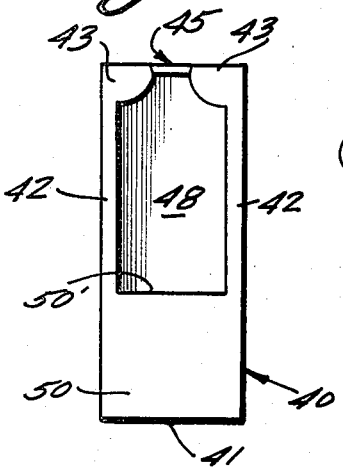
FIGS. 5 and 6 are front end and top plan views, respectively, of an exemplary rod dispenser according to the present invention.
Figure 6:
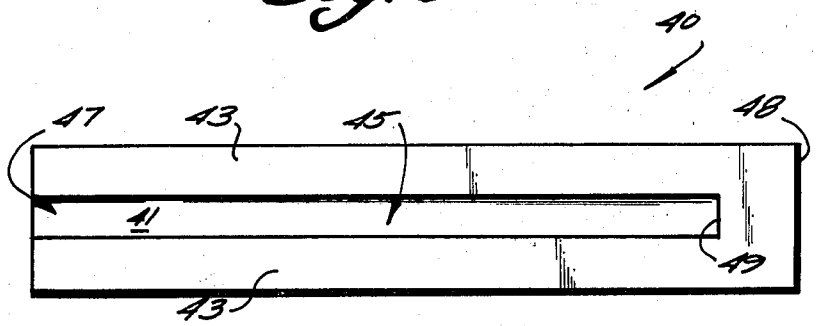

An exemplary rod dispenser according to the present invention is illustrated generally at 40 in FIGS. 4 through 6. The rod dispenser includes a base 41, a pair of substantially parallel sidewalls 42 upstanding perpendicularly to the base 41, and a pair of lips 43 integral with the sidewalls 42 and extending substantially perpendicular therefrom toward each other to define a channel 45 therebetween. The sidewalls 42, lips 43 and base 41 define an open front end 47 (see FIG. 6) so that a plurality of rods may be slid into and out of the device 40. Preferably a rear end wall 48 also is provided opposite the open end 47 and covering substantially the entire area between the base 41, sidewalls 42 and lips 43. An extension 49 (see FIG. 6) of each of the lips 43 adjacent the rear end wall 48 is provided forming an integral end termination of the channel 45 adjacent, but spaced from, the rear end wall 48. Also, to facilitate support of the dispenser 40 in the tray 36, a front end wall portion 50 (see FIG. 5) is provided integral with the base 41 and sidewalls 42 and extending upwardly from the base 41 a portion of the height of the sidewalls 42 to partially close the open front end 47, but having a top surface 50' spaced from the bottom of the lips 43 a distance at least as great as the length of a rod neck.

Figure 7:
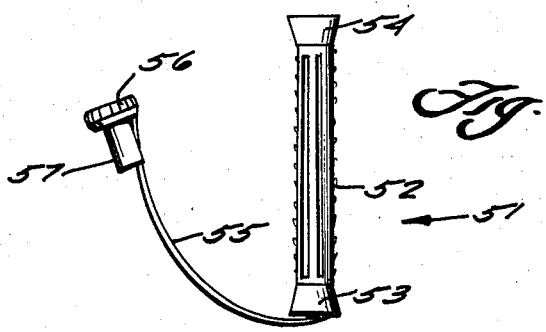
FIG. 7 is a side view of an exemplary rod for dispensing by the structure of FIGS. 5 and 6.

An exemplary conventional rod to be dispensed by the device 40 is illustrated in FIG. 7. The rod 51 includes a neck 52 having a head 54 at one end thereof. Another head 53 can be provided at the other end of the neck 52, although the length of the portions 52, 53 combined is considered to be the length of the neck. An elastic band 55 is attached to the head 53 and extends to a cap 56 integral with a plug 57. An opening (not shown) in the top of the head 54 is adapted to receive the plug 57, with the band 55 placed under slight tension in this position. The sidewalls 42, lips 43, channel 45, and the like are dimensioned with respect to the rod 51 to properly receive a plurality of rods therein (see FIG. 4). The width of the channel 45 is slightly greater than the diameter of the neck 52, but slightly less than the diameter of the head 54 (at its widest point since it is preferably in the shape of a truncated cone). The distance from the top of each lip 43 to the top 50' of the front wall portion 50 is at least as great, and preferably slightly greater, than the length of the neck 52 and head 53 combined. When rods 51 are inserted into the device 40, preferably the plugs 57 are in place in association with the heads 54.

Figure 8:
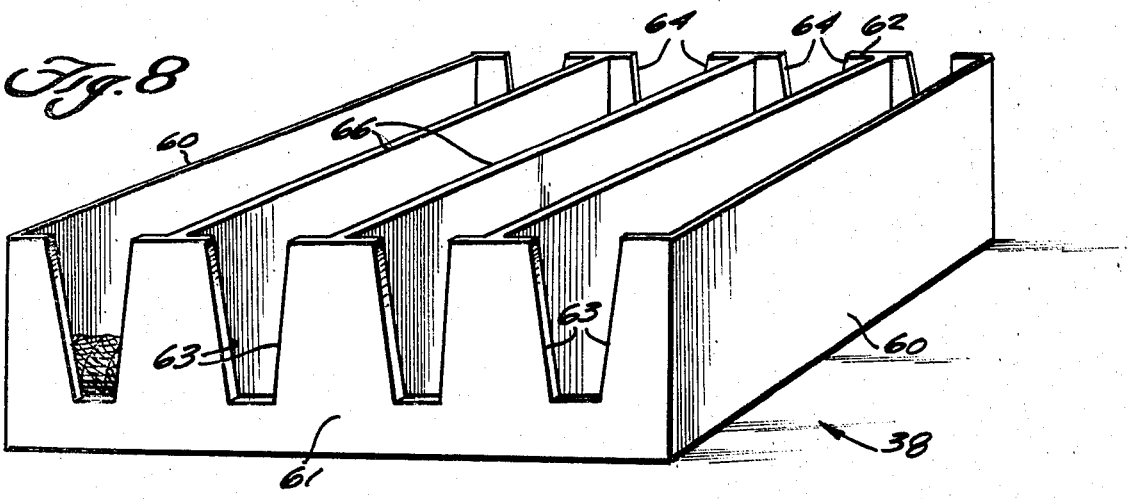
FIG. 8 is a perspective view of an exemplary hair roller dispensing device according to the present invention.
Figure 9:
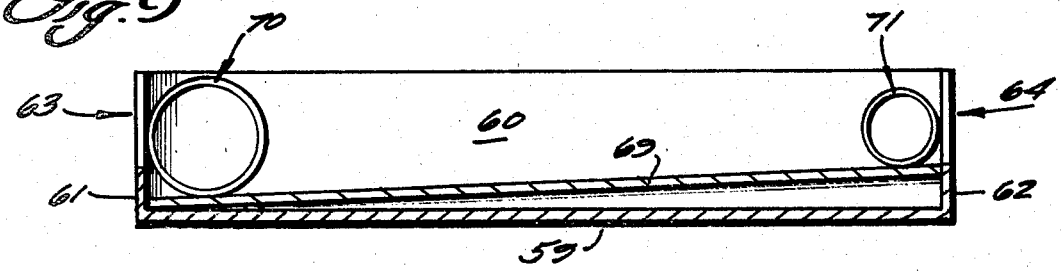
FIG. 9 is a side cross-sectional view of the dispenser of FIG. 8.

An exemplary dispensing tray 38 for hair rollers is illustrated in FIGS. 4, 8 and 9. Each device 38 comprises a base 59, first and second sidewalls 60, and third and fourth sidewalls 61, 62, respectively. The sidewalls 60, 61, 62 upstand from the base 59 perpendicular thereto, with the first and second sidewalls 60 being substantially parallel to each other and the third and fourth sidewalls 61, 62 being substantially parallel to each other. Means are provided defining at least one longitudinal slot in each of the third and fourth sidewalls (i.e., slots 63 in third sidewall 61 and slots 64 in fourth sidewall 62). The slots 63, 64 are open at the top and terminate short of the base 59, and preferably are tapered as illustrated in FIG. 8.

Preferably a plurality of dividing walls 66 are also provided in the tray 38, each dividing wall 66 parallel to the first and second walls 60. There will be one less dividing wall 66 than there are slot sets 63, 64, as illustrated in FIG. 8. The distance between each sidewall 60 and a dividing wall 66, or between adjacent walls 66, is at least as great as the length of a hair roller (e.g., rollers 70, 71) to be received thereby.

The tray 38 also comprises a floor 69 (see FIG. 9) disposed between the sidewalls and above the base 59. The floor 69 slopes from the fourth wall 62 downwardly toward the third wall 61. In this way, rollers when removed from a slot 63 will roll down toward the third wall 61 in a self-feeding manner, without springs or accessory devices. Also, relatively large rollers 70 may readily be supported adjacent the third wall 63, while relatively smaller rollers 71 are supported adjacent the fourth wall 64.

In practicing a method according to the present invention, the cosmetologist will sit a customer at a predetermined site, and will utilize a disposal container 26 containing end-wrap paper 29 stacked in a self-feeding manner within the container 26, a wrist mountable end-wrap paper holder 10, and a support structure 32 for supporting a plurality of hair roller dispensing trays 38 therein, and for supporting a rod dispenser 40 thereon (see FIG. 4). The method is practice without customer assistance and without the necessity of the cosmetologist leaving the customer or interrupting the treatment to fumble around and find accoutrements, separate end-wrap papers, or the like.

In practicing a method of cosmetology according to the present invention, the cosmetologists inserts a disposable container 26 into the end-wrap paper holder 10 so that the container 26 is received between the sidewalls 19 and lips 20 and single end wall 24 with the end-wrap paper 29 extending upwardly through the open-top 28 of the holder. The end-wrap paper holder 10 is then mounted onto the cosmetologist's wrist using the strap 14 and fasteners 15, 16. The support structure 32 is placed adjacent the site so that the rods 51 with elastic bands 55 supported thereby, and the rollers 70, 71 supported therein are readily accessible.

In actually performing treatments, the cosmetologist removes end-wrap papers one-at-a-time, as needed, from the wrist-mounted holder 10 while treating the customer's hair. Should the container 26 become empty during treatment, the cosmetologist merely withdraws the container from the holder 10, disposes of it, and inserts a filled container 26 in the holder without substantial interruption of the hair treatment. The cosmetologist remove rods 51 one-at-a-time from the dispenser 40 on top of the tray 36 by grabbing the rod head 54 (and/or plug top 56) and sliding it in channel 45 to the open end 47 of dispenser 40. This removal takes place without tangling of rod bands 55, and the rods are utilized one-at-a-time on the customer's hair. The trays 38 are slightly withdrawn from the structure 32 (or completely withdrawn and placed on top of the tray 36), and hair rollers 70, 71 of any desired size are removed one-at-a-time from the dispenser 38 without the cosmetologist leaving the site, and without customer assistance.

It will be thus be seen that according to the present invention various structures, devices ,accoutrements, and a method have been provided that makes a cosmetologist's operation much more professional and efficient. While the invention has been herein shown and described in what is preferably conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures, devices, and methods.

What is claimed is:

1. A device for dispensing rods each having a neck and head, in combination with a tray; said device comprising a base; a pair of substantially parallel sidewalls substantially perpendicular to said base; a pair of lips integral with said sidewalls and extending substantially perpendicularly therefrom toward each other to define a channel therebetween, said channel having a width slightly greater than the diameter of a rod neck, and slightly smaller than the diameter of a rod head; said sidewalls extending a distance from the top of said base to the bottom of said lips at least as great as the length of a rod neck; said sidewalls, lips, and base defining an open front end so that a plurality of rods may be slid into and out of said device with each rod having a head engaging the tops of said lips adjacent said channel, and the rod necks extending into said device; a rear end wall opposite said open end covering substantially the entire area between said base, sidewalls, and lips; an extension of each of said lips adjacent said rear end wall an integral end termination of said channel adjacent said rear end wall; and a front end wall portion integral with said base and sidewalls and extending upwardly from said base a portion of height of said sidewalls to partially close said device open front end but having a top surface spaced from the bottom of said lips a distance at least as great as the length of a rod neck; and said tray having a bottom surface and a plurality of sidewalls, each sidewall of said tray having substantially the same height as the height of said front end wall portion, and said tray being dimensioned to snugly receive a plurality of said bases.

2. A device for dispensing hair rollers, comprising:

a base; first, second, third, and fourth sidewalls upstanding from said base substantially perpendicular thereto, said first and second sidewalls being substantially parallel to each other, and said third and fourth sidewalls being substantially parallel to each other and having the same height, measured from said base, means defining at least one longitudinal slot in each of said third and fourth walls open at the top of the wall and terminating short of said base; a floor disposed between said sidewalls and above said base and sloping from said fourth wall downwardly toward said third wall; said first and second walls being spaced apart a distance at least as great as the length of a hair roller to be held by the device; a plurality of dividing walls disposed in said device parallel to said first and second walls and terminating at said third and fourth walls, said dividing walls each being spaced from each other, or from an adjcent first or second wall, a distance at least as great as the length of a hair roller to be held by the device; said means defining a slot in said third and fourth walls defining a slot in each of said third and fourth walls between each of said dividing walls, and between a dividing wall and said first wall, and between a dividing wall and said second wall; and a plurality of hair rollers disposed in the volume defined by said dividing walls, and sidewalls, and supported by said bottom.

3. A device as recited in claim 2 in combination with a support means for supporting a plurality of said devices in stacked relationship so that they are slidable into and out of said support means and closely vertically spaced so that access to said devices when completely within said support means is prevented; and wherein said support means has formed integrally with the top thereof a tray supporting a plurality of devices for dispensing rods.

4. A device as recited in claim 3 wherein each of said devices for dispensing rods comprises:

a base; a pair of substantially parallel sidewalls substantially perpendicular to said base; a pair of lips integral with said sidewalls and extending substantially perpendicularly therefrom toward each other to define a channel therebetween, said channel having a width slightly greater than the diameter of a rod neck, and slightly smaller than the diameter of a rod head; said sidewalls extending a distance from the top of said base to the bottom of said lips at least as great as the length of a rod neck; and said sidewalls, lips, and base defining an open front end so that a plurality of rods may be slid into and out of said device with each rod having a head engaging the tops of said lips adjacent said channel, and the rod necks extending into said device.

* * * * *